United States Patent [19]

Miyasaka et al.

[11] Patent Number: 4,844,863

[45] Date of Patent: Jul. 4, 1989

[54] METHOD OF PRODUCING CLAD METAL

[75] Inventors: Akihiro Miyasaka; Hiroyuki Ogawa, both of Sagamihara; Hiroyuki Homma, Tokyo; Saburo Kitaguchi; Hiroshi Morimoto, both of Sagamihara; Satoshi Araki, Hikari, all of Japan

[73] Assignee: Nippon Steel Corporation, Tokyo, Japan

[21] Appl. No.: 172,633

[22] Filed: Mar. 24, 1988

[30] Foreign Application Priority Data

| | | | |
|---|---|---|---|
| Mar. 25, 1987 | [JP] | Japan | 62-69127 |
| Mar. 30, 1987 | [JP] | Japan | 62-74484 |
| Mar. 30, 1987 | [JP] | Japan | 62-74485 |
| Feb. 25, 1988 | [JP] | Japan | 63-40644 |

[51] Int. Cl.[4] ..... B22F 7/00

[52] U.S. Cl. ..... 419/8; 419/28; 419/29; 419/49

[58] Field of Search ..... 419/8, 49, 28, 29

[56] References Cited

U.S. PATENT DOCUMENTS

| | | | |
|---|---|---|---|
| 3,652,235 | 3/1972 | Manilla et al. | 29/194 |
| 3,753,704 | 8/1973 | Manilla et al. | 29/194 |
| 4,065,302 | 12/1977 | Turillon | 419/8 |
| 4,627,958 | 12/1986 | Hays | 419/8 |
| 4,657,822 | 4/1987 | Goldstein | 419/8 |
| 4,747,225 | 5/1988 | Gstettner et al. | 42/76.02 |

FOREIGN PATENT DOCUMENTS

| | | |
|---|---|---|
| 61-190007 | 8/1986 | Japan . |
| 61-190008 | 8/1986 | Japan . |
| 61-223106 | 10/1986 | Japan . |

*Primary Examiner*—Stephen J. Lechert, Jr.
*Attorney, Agent, or Firm*—Kenyon & Kenyon

[57] ABSTRACT

A method of producing clad metal comprises the steps of forming a cladding on the surface of a metal substrate by subjecting powder of a metal which is of a different type from that of the metal substrate and is selected from among Ni-base alloys, Co-base alloys, Ti-base alloys, Fe-base superalloys and stainless steels to hot isostatic pressing under a gas pressure load of not less than 300 Kg/cm$^2$ at a temperature not higher than the solidus thereof, thereby to obtain a composite material, and elongating the composite material by hot working. Optionally the composite material is subjected to soaking or solution treatment before being subjected to hot working.

12 Claims, 1 Drawing Sheet

METHOD OF PRODUCING CLAD METAL

BACKGROUND OF THE INVENTION

1. Field of the Invention

This invention relates to a method of producing clad metal, more particularly to a method of cladding the surface of a metal with a layer exhibiting corrosion resistance, resistance to hot corrosion, oxidation resistance, wear resistance and other superior characteristics.

2. Description of the Prior Art

Recent industrial and technological advances have been creating a need for materials that can be used in increasingly severe environments. The field of energy resource development is one example. Development is now being directed to recovery of fluids such as sour oil and sour gas, i.e. petroleum and natural gas containing large quantities of hydrogen sulfide and carbon dioxide. Tubular goods and linepipes made of low alloy steel are not suitable for this work since they are apt to corrode and crack. As a result, Ni-base alloy products such as Hastelloy C-276 and Inconel 625 (tradenames) are already being used. The high price of these metals is, however, a major problem. It has therefore been contemplated to use clad steel goods having one of these alloys only as a cladding, the required strength being provided by the metal substrate (low alloy steel, for example).

Various methods for producing clad steel products have been proposed, specifically for producing tubular goods such as seamless pipes or welded pipes and flat products as rolled plates. In all cases, however, the process is complicated and the yield is low. What is more, it has been found difficult to produce clad steels which use Hastelloy C-276 or Inconel 625 as the cladding material. This difficulty is even greater in the case of clad steel tubes and no practicable method has been developed heretofore. Studies carried out by the inventors show that this difficulty results from the fact that in the course of hot working the flow stress exhibited by these alloys is much greater than that exhibited by the metal substrate. Thus hot working and other conventional production process cannot be used since the two types of metal deform independently of each other, making it impossible to uniformly process the cladding and the metal substrate. This makes bonding of the two metals difficult.

Clad steels are also used in other applications. It is common, for example, to clad the sliding surfaces of valve spindles, the piston and cylinder walls of reciprocal pumps, and the inner surface of pipes for carrying slurries, so as to make them more resistant to wear. In these cases, a cladding of an alloy such as Stellite (tradename) is applied by overlaying or spraying. Further, pressure vessels and steel pipes used at high temperatures are provided by overlaying or spraying with a cladding of oxidation resistant material such as Ni—Cr alloy, Ni—Cr—Al—Y alloy or Co—Cr—Al—Y alloy. However, in all such cases it is the finished product that is provided with the cladding by overlaying or spraying and this makes the cost very high. In addition, these methods are incapable of providing a cladding on a surface that is difficult of access, as on the inner surface of a small diameter pipe.

On the other hand, it has been proposed to produce clad products using the well-known hot isostatic pressing method. For example, Japanese Patent Public Disclosure 61(1986)-223106 discloses a method for high efficiency production of alloy clad products by heating high alloy powder to a temperature above the solidus while subjecting it to gas pressing. However, in the disclosed method, as well as in all other methods employing hot isostatic pressing that have reported, the method of producing the clad product is carried out on a finished product and, as a result, the cost is high. Moreover, these methods are incapable of producing large products or long products measuring, for example, 12 meters or more in length.

Further, in Japanese Patent Public Disclosure Nos. 61(1986)-190007 and 61(1986)-190008 there are disclosed methods wherein a powder is charged into a capsule formed of a thick malleable metal cylinder and a thin metal cylinder of different diameter from the thick cylinder, the capsule is subjected to cold isostatic pressing to compress the powder into a billet, and the billet is subjected to hot extrusion, or wherein a double-walled vessel consisting of two concentric cylinders one inside the other is made of rubber or like material, a cylindrical malleable metal material is accommodated in the vessel in intimate contact with one of the vessel walls, powder material is charged in between the other vessel wall and the aforesaid cylindrical material and, after being sealed the vessel is subjected to cold isostatic pressing, the material thereafter removed from the vessel being used as a billet to be subjected to hot extrusion. However, these methods are unable to overcome the problem that when hot working is carried out on an assembly consisting of a metal substrate clad with a material exhibiting a large flow stress such as Hastelloy C-276, Inconel 625 or other nickel alloys or the like, the joint strength between the metal substrate and the cladding is weak so that the cladding is apt to separate from the metal substrate or suffer cracking.

SUMMARY OF THE INVENTION

It is an object of the present invention to provide a method of producing clad metal which enables inexpensive production of a material consisting of a metal substrate and a cladding which provides the material with such desirable properties as corrosion resistance, resistance to hot corrosion, oxidation resistance and wear resistance.

The inventors carried out various experiments and studies regarding the hot working of a composite material constituted of a cladding consisting of a material with a large hot flow stress such as a nickel or cobalt alloy and a metal substrate consisting of a material with a relatively small hot flow stress such as a low alloy steel or a carbon steel. As a result, they discovered that if the hot working is carried out after the cladding and the metal substrate have been metallurgically bonded to obtain a high joint strength at the interface between the two members, it is possible to carry out simultaneous and uniform hot working of the cladding and the metal substrate and to obtain a hot worked product wherein the cladding and the metal substrate are metallurgically bonded with enough joint strength at the interface therebetween. The inventors further studied various methods for metallurgically bonding the cladding and the metal substrate prior to hot working so as to obtain a high joint strength therebetween and found that the hot isostatic pressing (HIP) method is superior to other methods in terms of cost, degree of joint strength and other factors. More specifically, they discovered that by using the HIP method, it is possible to form the metallic powder as a cladding on the metal substrate and that the composite obtained in this way exhibits high joint strength between the cladding and the metal substrate. Moreover, they discovered that even where the metal used for the cladding is Hastelloy, Stellite or some other material with poor workability, it is possible to provide the cladding-metal substrate composite with adequate hot workability if, in the HIP treatment carried out prior to hot working, pores are eliminated from the metallic powder cladding. They also discovered that the method they developed enables the production of clad products of long length.

It was further found that the hot workability of the cladding is greatly improved when the composite is subjected to soaking after HIP and that when such soaking is conducted, no cracks or other flaws occur in the cladding of the hot worked material even when the amount of hot working is great. In the course of cooling of the composite following HIP, coarse precipitates form in the cladding and the purpose of the soaking is to dissolve and eliminate these immediately before hot working. Studies conducted by the inventors show that optimum effect is obtained for a cladding constituted of an Ni—base or Co—base alloy when the soaking is carried out at 1050°-1240° C. for 0.5-10 h, while optimum effect is obtained for a cladding constituted of a Ti-base alloy when the soaking is carried out at 550°-900° C. for 0.5-10 h. In either case, after soaking it is important to carry out the hot working before coarse precipitates can form again.

The inventors further discovered that, similarly to the case where hot working is carried out immediately after soaking, the hot workability of the cladding is also greatly improved when the composite material is subjected to solution treatment and that in this case, too, the hot working can be carried out without producing cracks or other flaws in the cladding even when the amount of hot working is great. The purpose of the solution treatment is to dissolve and eliminate the coarse precipitates which form in the cladding during cooling following HIP. Studies conducted by the inventors show that optimum effect is obtained for a cladding constituted of an Ni-base or Co-base alloy when the solution treatment is carried out by holding the composite at 1050°-1240° C. for 0.5-10 h and by rapid cooling at the rate of at least 5 deg/sec, while optimum effect is obtained for a cladding constituted of a Ti-base alloy when the solution treatment is carried out by holding the composite at 550°-900° C. for 0.5-10 h and by rapid cooling at the rate of at least 5 deg/sec.

This invention was accomplished on the basis of the knowledge gained through the aforesaid discoveries. Briefly stated, the method which the inventors developed comprises the steps of forming a cladding on the surface of a metal substrate by subjecting powder of a metal which is of a different type from that of the metal substrate to hot isostatic pressing under a gas pressure load of not less than 300 kg/cm$^2$ at a temperature not higher than the solidus thereof, thereby to obtain a composite material, and elongating the composite material by hot working. In the aforesaid method the step of soaking the composite material or the step of subjecting the composite material to solution treatment may optionally be carried out between the step for forming a cladding by HIP treatment and the step for elongating the composite material by hot working.

The method of this invention puts no particular restriction on the types of the "metal substrate" and the "cladding" of which the metal is of a different type from that of the metal substrate. For example, for the metal substrate it is possible to use such metals as carbon steel, low alloy steel, stainless steel, nickel, nickel alloys, cobalt, cobalt alloys, titanium and titanium alloys, while the metal for the cladding can be selected from among, for example, Hastelloy, Stellite, Ni—Cr alloy, stainless steel, Fe-base superalloy, nickel nickel alloys, cobalt, cobalt alloys, titanium and titanium alloys, based on which of such properties as corrosion resistance, resistance to hot corrosion, oxidation resistance and wear resistance are required.

Other objects and advantages of the invention will become apparent from the following description taken in conjunction with the accompanying drawings.

DESCRIPTION OF THE PREFERRED EMBODIMENTS

Figure 1:
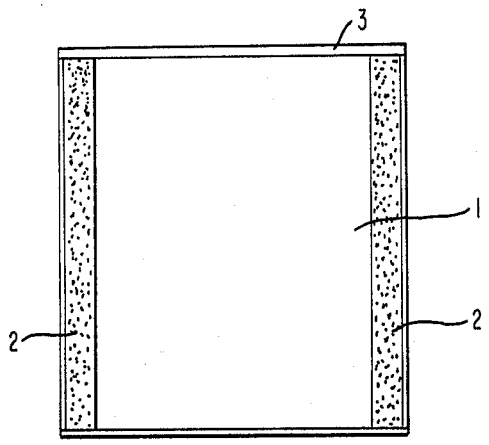
FIG. 1 is a vertical sectional view illustrating the manner in which a metal substrate and cladding powder of a metal different from that of the metal substrate are prepared for subjection to hot isostatic pressing.

In this invention, the surface of a substrate of a first type of metal is provided by HIP treatment with a cladding of a second type of metal. For example, as shown in FIG. 1, a metal substrate 1 of the first type and a metal powder 2 of the second type destined to become the cladding are charged into a capsule 3 in the illustrated manner and the capsule is sealed. The first and second types of metal are then subjected to HIP treatment as contained in the capsule, thereby to form the metal powder into a cladding on the metal substrate such that the cladding and the metal substrate are metallurgically bonded to one another with a high joint strength at the interface therebetween. In carrying out this process, it is necessary to ensure that the cladding will have good hot workability in the ensuing step. For this it is important to ensure that no pores remain in the cladding. It is therefore important to carry out the HIP treatment under adequately high temperature and pressure and with the interior of the sealed capsule vacuumized. The degree of vacuum should be $1\times10^{-3}$ Torr or better.

While the appropriate HIP temperature will vary depending on the type of metal substrate and cladding used, it has to be below the solidus both metals to ensure good hot working. This is because when the HIP temperature exceeds the solidus, the constituent elements of the metals will segregate during cooling, greatly degrading the hot workability in the succeeding step. For shortening the HIP treatment time, however, it is effective to select the highest possible temperature within the aforesaid range. Selection of a higher HIP temperature, makes it possible to lower the HIP pressure and/or shorten the HIP time. However, when the HIP pressure is less than 300 kg/cm$^2$, the sintering of the powdered metal of the second type (the cladding metal) will invariably be insufficient regardless of what time and temperature conditions are selected and the cladding will not acquire adequate hot workability. For assuring good hot workability, therefore, it is necessary for the HIP temperature to be not less than 300 kg/cm$^2$ When the cladding metal is an Ni- base alloy or a Co-base alloy, an HIP temperature of 1050°-1240° C. and an HIP time of 0.5-10 h are necessary. This is because when the HIP temperature is lower than 1050° C., the required HIP time becomes several tens of hours, which is impracticably long, and when it is higher than 1240° C., the hot workability is degraded for the reason mentioned earlier, and because when the HIP time is less than 0.5 h, it is difficult to obtain a cladding with good hot workability no matter how high a temperature is selected within the aforesaid temperature range, and when it is more than 10 h, the period exceeding 10 h produces no additional effect.

When the cladding metal is a Ti-base alloy and the metal substrate is an iron base alloy (carbon steel, low alloy steel, stainless steel, etc.), an HIP temperature of 600°-900° C. and an HIP time of 0.5-10 h are necessary. This is because when the HIP temperature is lower than 600° C., the required HIP time becomes several tens of hours, which is impracticably long, and when it is higher than 900° C., the hot workability is degraded because Ti and Fe react to form a brittle compound, and because when the HIP time is less than 0.5 h, it is difficult to obtain a cladding with good hot workability no matter how high a temperature is selected within the aforesaid temperature range, and when it is more than 10 h, the period exceeding 10 h produces no additional effect.

The main purpose of carrying out soaking is to dissolve and eliminate the coarse precipitates which form in the cladding during cooling following HIP and thus to ensure even better hot workability in the succeeding hot working step. Studies conducted by the inventors show that optimum effect is obtained for a cladding constituted of an Ni-base or Co-base alloy when the soaking is carried out by holding the composite at 1050°-1240° C. for 0.5-10 h, while optimum effect is obtained for a cladding constituted of a Ti-base alloy when the soaking is carried out by holding the composite at 550°-900° C. for 0.5-10 h. The reasons for these temperature and time ranges are as follows. When the soaking temperature for an Ni-base alloy or a Co-base alloy is lower than 1050° C. or the soaking temperature for a Ti-base alloy is less than 550° C., the precipitates do not dissolve, and when the soaking temperature for an Ni-base alloy or a Co-base alloy is higher than 1240° C. or the soaking temperature for a Ti-base alloy is higher than 900° C., the hot workability of the cladding and/or of the interface between the cladding and metal substrate is not improved but degraded. Regarding the time range, on the other hand, when the holding time is less than 0.5 h, the precipitates do not sufficiently dissolve even when the soaking temperature is set at the upper limit of the aforesaid range and when it is greater than 10 h, the period exceeding 10 h produces no additional effect. The holding time should therefore be 0.5-10 h. Further, since precipitates that will degrade hot workability are likely to form again in the cladding when the composite cools following soaking, it is necessary to transport the composite to the position for hot working as quickly as possible after soaking is completed.

The main purpose of the solution treatment is similar to that of the aforesaid soaking, namely to dissolve and eliminate the coarse precipitates which form in the cladding during cooling following HIP and thus to ensure even better hot workability in the succeeding hot working step. Studies conducted by the inventors show that optimum effect is obtained for a cladding constituted of an Ni-base or Co-base alloy when the solution treatment is carried out by holding the composite at 1050°-1240° C. for 0.5-10 h and by rapid cooling at the rate of at least 5 deg/sec, while optimum effect is obtained for a cladding constituted of a Ti-base alloy when the solution treatment is carried out by holding the composite at 550°-900° C. for 0.5-10 h and by rapid cooling at the rate of at least 5 deg/sec. The reasons for these temperature and time ranges are as follows. When the solution treatment temperature for an Ni-base alloy or a Co-base alloy is lower than 1050° C. or the solution treatment temperature for a Ti-base alloy is lower than 550° C., the precipitates do not dissolve, and when the solution treatment temperature for an Ni-base alloy or a Cobase alloy is higher than 1240° C. or the solution treatment temperature for a Ti-base alloy is higher than 900° C., the hot workability of the cladding and/or of the interface between the cladding and the metal substrate is not improved but degraded. Regarding the time range on the other hand, when the holding time is less than 0.5 h, the precipitates do not sufficiently dissolve even when the solution treatment temperature is set at the upper limit of the aforesaid range and when it is greater than 10 h, the period exceeding 10 h produces no additional effect. The holding time should therefore be 0.5-10 h. Moreover, when the cooling rate after holding at solution treatment temperature is less than 5 deg/sec, precipitates form again in the course of the cooling and impair the hot workability. It is thus necessary to use a cooling rate of not less than 5 deg/sec. As the method for obtaining such a cooling rate, it is possible to employ water cooling or forced air cooling.

In this invention, following formation of the cladding, the resulting composite material is subjected to hot working, or, optionally, subjected to soaking and immediately thereafter to hot working, or, optionally, subjected to solution treatment and thereafter to hot working. Even though the result of the aforesaid formation of the cladding is a composite material, it can be hot worked in the ordinary manner. The purpose of the hot working step in this invention is to elongate the clad metal material and thus obtain a long clad metal material or to produce a clad metal material of complex configuration. Thus, in accordance with the desired shape of the final product, the composite is subjected to hot rolling, hot forging, hot extrusion or some other hot working process. In this invention, "hot working" is defined as working within a temperature range that is normal for the deformation etc. of the metal substrate and the cladding. However, it should be noted that it is necessary to select a hot working temperature that is suitable for both the metal substrate and the cladding.

Where a plate-shaped product is to be produced by the method of this invention, the cladding can be provided on either or both of its top and bottom surfaces, and when a tubular product is to be produced, the cladding can be provided on either or both of the inner and outer surfaces. Whether one or two surfaces are clad can be appropriately selected with consideration to the intended use of the product.

After the hot working has been completed, the clad material can then be subjected to such other processes as quenching and tempering or a heat treatment such as normalizing, for enhancing the strength and ductility of the metal substrate, or to a heat treatment such as solution treatment or annealing for further improving the corrosion resistance of the cladding, or to a cold working or other preferable working for shaping the product. The processes to be carried out can be selected according to the required strength, ductility, corrosion resistance, etc.

The method of this invention can, for example, be applied to produce products requiring resistance to corrosive substances, products requiring resistance to high-temperature oxidation, and products requiring resistance to wear. It can further be applied to products of various shapes such as tubes, vessels and rods. It is also of course applicable to the production of semifinished products to be used for the manufacture of finished products by forming, welding or the like.

The invention will now be described with respect to specific examples.

EXAMPLE 1

Figure 2:
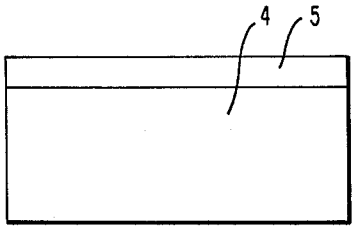
FIGS. 2 to 5 are cross-sectional views for showing how layers are formed by HIP treatment in materials processed according to the method of this invention.
Figure 3:
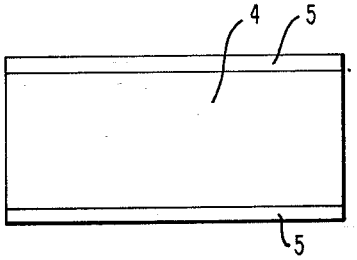
Figure 4:
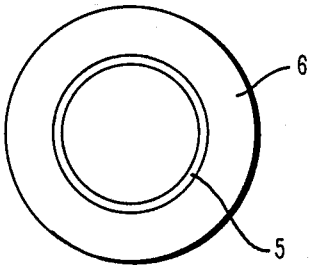
Figure 5:
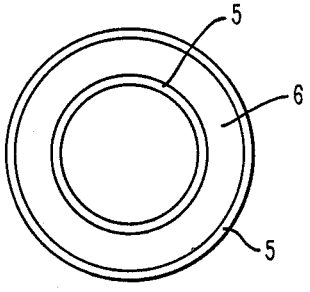

Composite materials for subjection to hot working were produced using the materials and production conditions shown in Table 1. In this table, Invention Examples Nos. 1 and 2 relate to slabs with a cladding on the top surface, Nos. 3–5 relate to slabs with claddings on both surfaces, and Nos. 6–12 relate to hollow billets with a cladding on the inner surface, and Nos. 13–16 to hollow billets with claddings on both the inner and outer surfaces. In each case, the cladding was formed on the metal substrate by subjecting an alloy powder and the metal substrate to HIP treatment. The shapes of the resulting composite materials are shown in FIGS. 2–5. FIG. 2 shows an example in which a cladding 5 was formed on the top surface of a slab 4. FIG. 3 shows an example in which claddings 5 were formed on both the top and bottom surfaces of a slab 4. FIG. 4 shows an example in which a cladding 5 was formed on the inner surface of a hollow billet 6. And FIG. 5 shows an example in which claddings 5 were formed on both the inner and outer surfaces of a hollow billet 6.

Each of Comparative Examples 17–22 in the same table relates to a case in which the top surface of a slab was provided with a cladding by subjecting the slab and an alloy powder to HIP treatment but in which the condition marked by an asterisk in the table fell outside the range defined by the present invention. Comparative Examples 23 and 24 relate to cases employing a conventional method in which a slab assembly (a billet assembly) was produced using a plate (a tube) as the aforesaid second type of metal (the metal for the cladding) and the slab assembly (billet assembly) was thereafter subjected to hot working. In the case of the slab assembly, the hot working carried out was hot rolling, and in the case of the billet assembly it was hot extrusion.

The materials listed in Table 1 were hot worked under the conditions shown in Table 2 to produce clad metal materials. The results obtained are also shown in FIG. 2, as are the results of various tests carried out on those products for which good results were obtained in the hot working. The bending test referred to in Table 2 was carried out in accordance with JIS G 0601 and JIS Z 3124, the shear strength test was conducted in accordance with JIS G 0601 and the ultrasonic examination was conducted in accordance with JIS G 0601 and JIS Z 2344.

In the case of the Comparative Examples Nos. 17–22 shown in Table 2, cracking occurred in the cladding during hot working. This is attributable to the fact that the HIP temperature was too high in the case of Comparative Examples 17, 19 and 21 and the HIP pressure was too low in the case of Comparative Examples 18, 20 and 22. In Comparative Example Nos. 23 and 24, uniform processing could not be obtained between the metal substrate and the cladding and these two members could not be bonded to each other by the hot working. This is because they were not bonded together prior to the hot working.

In contrast, Invention Examples Nos. 1–16 all exhibited excellent properties in the bending test and the shear strength test and showed no unbonded parts or other defects in the ultrasonic examination. Further, microscopic observation of the cross-sections of these examples after hot working revealed absolutely no pores in the claddings. Moreover, in each case, the interface between the cladding and the metal substrate was found to be uniform and in excellent condition.

EXAMPLE 2

Composite materials for subjection to hot working were produced using the materials and production conditions shown in Table 3. In this table, Invention Examples Nos. 1 and 2 relate to slabs with a cladding on the top surface, No. 3 relates to a slab with claddings on both surfaces, Nos. 4–8 relate to hollow billets with a cladding on the inner surface, and Nos. 9–11 relate to hollow billets with claddings on both the inner and outer surfaces. In each case, the cladding was formed on the metal substrate by subjecting an alloy powder and the metal substrate to HIP treatment. The shapes of the resulting composite materials are shown in FIGS. 2–5. FIG. 2 shows an example in which a cladding 5 was formed on the top surface of a slab 4. FIG. 3 shows an example in which claddings 5 were formed on both the top and bottom surfaces of a slab 4. FIG. 4 shows an example in which a cladding 5 was formed on the inner surface of a hollow billet 6. And FIG. 5 shows an example in which claddings 5 were formed on both the inner and outer surfaces of a hollow billet 6.

Each of Comparative Examples in the same table relates to a case in which the inner surface of a hollow billet was provided with a cladding by subjecting the billet and an alloy powder to HIP treatment but in which the condition marked by an asterisk in the table fell outside the range defined by the present invention.

The materials listed in Table 3 were hot worked under the conditions shown in Table 4 to produce clad metal materials. The results obtained are also shown in FIG. 4, as are the results of various tests carried out on those products for which good results were obtained in the hot working. The bending test referred to in Table 4 was carried out in accordance with JIS G 0601 and JIS Z 3124, the bonding strength test was conducted in accordance with JIS H 8664, and the defect length ratio of the bonded portion was obtained by dividing the length of the unbonded parts as measured by optical microscopic observation by the total length of the interface.

In the case of the Comparative Examples Nos. 12–17 shown in Table 4, although hot working could be carried out, cracking occurred in the cladding. This is attributable to the fact that the soaking temperature was too low in the case of Comparative Examples 12, 14 and 16 and that no soaking was conducted in the case of Comparative Examples 13, 15 and 17. In contrast, Invention Examples Nos. 1–11 all exhibited excellent properties in the bending test and the bonding strength test, and the optical microscopic examination revealed no unbonded parts or other defects. Further, microscopic observation of the cross-sections of these examples after hot working revealed absolutely no pores or cracks in the claddings. Moreover, in each case, the interface between the cladding and the metal substrate was found to uniform and in excellent condition. An excellent clad metal was obtained even in cases where the amount of hot working was extremely large.

EXAMPLE 3

Composite materials for subjection to hot working were produced using the materials and production conditions shown in Table 5. In this table, Invention Examples Nos. 1 and 2 relate to slabs with a cladding on the top surface, No. 3 relates to a slab with claddings on both surfaces, Nos. 4–8 relate to hollow billets with a cladding on the inner surface, and Nos. 9–11 relate to hollow billets with claddings on both the inner and outer surfaces. In each case, the cladding was formed on the metal substrate by subjecting an alloy powder and the metal substrate to HIP treatment. The shapes of the resulting composite materials are shown in FIGS. 2–5. FIG. 2 shows an example in which a cladding 5 was formed on the top surface of a slab 4. FIG. 3 shows an example in which claddings 5 were formed on both the top and bottom surfacs of a slab 4. FIG. 4 shows an example in which a cladding 5 was formed on the inner surface of a hollow billet 6. And FIG. 5 shows an example in which claddings 5 were formed on both the inner and outer surfaces of a hollow billet 6.

Each of the Comparative Examples in the same table relates to a case in which the inner surface of a hollow billet was provided with a cladding by subjecting the billet and an alloy powder to HIP treatment but in which the condition marked by an asterisk in the table fell outside the range defined by the present invention.

The materials listed in Table 5 were hot worked under the conditions shown in Table 6 to produce clad metal materials. The results obtained are also shown in FIG. 6, as are the results of various tests carried out on those products for which good results were obtained in the hot working. The bending test referred to in Table 6 was carried out in accordance with JIS G 0601 and JIS Z 3124, the bonding strength test was conducted in accordance with JIS H 8664, and the defect length ratio of the bonded portion was obtained by dividing the length of the unbonded parts as measured by optical microscopic observation by the total length of the interface.

In the case of the Comparative Examples Nos. 12–20 shown in Table 6, although hot working could be carried out, cracking occurred in the cladding. This is attributable to the fact that the solution treatment temperature was too low in the case of Comparative Examples 12, 15 and 18, that the cooling rate after holding at the solution treatment temperature was too low in the case of Comparative Examples 13, 16 and 19, and that no solution treatment was carried out in the case of Comparative Examples 14, 17 and 20. In contrast, Invention Examples Nos. 1–11 all exhibited excellent properties in the bending test and the bonding strength test, and the optical microscopic examination revealed no unbonded parts or other defects. Further, microscopic observation of the cross-sections of these examples after hot working revealed absolutely no pores or cracks in the claddings. Moreover, in each case, the interface between the cladding and the metal substrate was found to be uniform and in excellent condition. An excellent clad metal was obtained even in cases where the amount of hot working was extremely large.

Thus, as is clear from the foregoing description, the present invention enables production of clad metal exhibiting excellent properties.

TABLE 1

| | Test No. | Metal substrate: Material JIS No. | Metal substrate: Thickness or diameter (mm) | Cladding: Material | Cladding: Principal components (wt %) | Cladding: Thickness (mm) | Surface clad | HIP Conditions: Temp. (°C.) | HIP Conditions: Time (h) | HIP Conditions: Pressure (kgf/cm$^2$) |
|---|---|---|---|---|---|---|---|---|---|---|
| Invention | 1 | SB 42 | 200 t | Cobalt alloy | 28Cr—6Mo—2.5Ni—0.25C-balance Co | 10 | Top surface | 1200 | 1 | 1000 |
| | 2 | SB 42 | 200 t | Nickel alloy | 70Ni—30Cu | 20 | of slab | 1060 | 5 | 1700 |
| | 3 | SB 42 | 100 t | Nickel alloy | 16Cr—16Mo—5Fe—4W—2Co-balance Ni | both 10 | Top and | 1150 | 1 | 2000 |
| | 4 | SUS 316 | 100 t | Nickel alloy | 16Cr—16Mo—5Fe—4W—2Co-balance Ni | both 10 | bottom | 1150 | 3 | 1500 |
| | 5 | SUS 316 | 100 t | Nickel alloy | 28Mo—5Fe—2Co-balance Ni | both 5 | surfaces of slab | 1150 | 3 | 1800 |
| | 6 | SCM 430 | Outer diam.: 170 ϕ Inner diam.: 78 ϕ | Nickel alloy | 16Cr—16Mo—5Fe—4W—2Co-balance Ni | 5 | Inner surface of hollow round billet | 1200 | 1 | 2000 |
| | 7 | SCM 430 | Outer diam.: 170 ϕ Inner diam.: 78 ϕ | Cobalt alloy | 35Ni—20Cr—10Mo—35Co | 5 | | 1200 | 5 | 2000 |
| | 8 | SCM 430 | Outer diam.: 170 ϕ Inner diam.: 88 ϕ | Pure Ti | 100Ti | 10 | | 850 | 3 | 2000 |
| | 9 | SUS 310S | Outer diam.: 170 ϕ Inner diam.: 78 ϕ | Nickel alloy | 16Cr—16Mo—5Fe—4W—2Co-balance Ni | 5 | | 1200 | 3 | 700 |
| | 10 | SUS 316 | Outer diam.: 170 ϕ Inner diam.: 78 ϕ | Nickel alloy | 22Cr—9Mo—3.5Nb—3Fe-balance Ni | 5 | | 1130 | 7 | 700 |
| | 11 | SCM 420 | Outer diam.: 170 ϕ Inner diam.: 88 ϕ | JIS No. SUS 316L | 17Cr—12Ni—2Mo-balance Fe | 10 | | 1100 | 2 | 1800 |
| | 12 | SCM 420 | Outer diam.: 170 ϕ Inner diam.: 88 ϕ | JIS No. SUS 310S | 25Cr—20Ni-balance Fe | 10 | | 1100 | 2 | 1800 |
| | 13 | SCM 430 | Outer diam.: 160 ϕ Inner diam.: 78 ϕ | Inner surface: Nickel alloy Outer surface: Cobalt alloy | Inner surface: 28Mo—5Fe—2Co-balance Ni Outer surface: 28Cr—6Mo—2.5Ni—0.25C-balance Co | Inner surface: 5 Outer surface: 5 | Inner and outer surfaces of hollow round billet | 1200 | 1 | 1500 |
| | 14 | SUS 347 | Outer diam.: 160 ϕ Inner diam.: 78 ϕ | Inner surface: Nickel alloy Outer surface: Nickel alloy | Inner surface: 22Cr—6Mo—19Fe—2Cu—2Nb-balance Ni Outer surface: 50Cr—50Ni | Inner surface: 5 Outer surface: 5 | | 1150 | 3 | 2000 |
| | 15 | STBA 24 | Outer diam.: 160 ϕ Inner diam.: 78 ϕ | Inner surface: JIS No. SUS 347H Outer surface: Stainless steel | Inner surface: 18Cr—12Ni—0.7Nb-balance Fe Outer surface: 27Cr—26Ni-balance Fe | Inner surface: 5 Outer surface: 5 | | 1130 | 3 | 1800 |
| | 16 | STBA 23 | Outer diam.: 160 ϕ Inner diam.: 78 ϕ | Inner surface: JIS No. SUS 347H Outer surface: Nickel alloy | Inner surface: 18Cr—12Ni—0.7Nb-balance Fe Outer surface: 50Cr—50Ni | Inner surface: 5 Outer surface: 5 | | 1130 | 5 | 1800 |
| Comparative examples | 17 | SCM 430 | 200 t | Nickel alloy | 16Cr—16Mo—5Fe—4W—2Co-balance Ni | 10 | Top surface of slab | 1370* | 3 | 1000 |
| | 18 | SCM 430 | 200 t | Nickel alloy | 16Cr—16Mo—5Fe—4W—2Co-balance Ni | 10 | | 1100 | 7 | 200* |
| | 19 | SCM 430 | 200 t | Cobalt alloy | 28Cr—6Mo—2.5Ni—0.25C-balance Co | 10 | | 1400* | 5 | 1600 |
| | 20 | SCM 430 | 200 t | Cobalt alloy | 28Cr—6Mo—2.5Ni—0.25C-balance Co | 10 | | 1170 | 5 | 250* |
| | 21 | SCM 430 | 200 t | Titanium alloy | 6Al—4V-balance Ti | 10 | | 1450* | 1 | 1000 |
| | 22 | SCM 430 | 200 t | Titanium alloy | 6Al—4V-balance Ti | 10 | | 820 | 8 | 150* |
| | 23 | SCM 430 | 200 t | Cobalt alloy | 28Cr—6Mo—2.5Ni—0.25C-balance Co | 10 | | Slab assembly # | | |
| | 24 | SCM 430 | Outer diam.: 170 ϕ Inner diam.: 78 ϕ | Nickel alloy | 16Cr—16Mo—5Fe—4W—2Co-balance Ni | 5 | Inner surface of hollow round billet | Billet assembly ## | | |

A substrate plate and a cobalt alloy plate were welded together around the entire peripheries thereof and the space there between was vacuumized.
A substrate tube and a nickel alloy tube fit one inside the other were welded at the both ends and the space there between was vacuumized.

TABLE 2

| | Test No. | Hot working method | Product dimentions: Heating temp. (°C.) | Product dimentions: Thickness or diameter of metal substrate (mm) | Product dimentions: Cladding thickness (mm) | Product test results: Bending Test | Product test results: Shearing Test (kg/mm$^2$) | Product test results: Ultrasonic examination |
|---|---|---|---|---|---|---|---|---|
| Invention | 1 | Hot rolling | 1120 | 20 t | 1 | Good | >30 (Not sheared up to 30) | Defect ratio 0% |
| | 2 | Hot rolling | 1100 | 20 t | 2 | Good | >30 (Not sheared up to 30) | Defect ratio 0% |
| | 3 | Hot rolling | 1150 | 20 t | both 2 | Good | >30 (Not sheared up to 30) | Defect ratio 0% |
| | 4 | Hot rolling | 1170 | 20 t | both 2 | Good | >30 (Not sheared up to 30) | Defect ratio 0% |
| | 5 | Hot rolling | 1170 | 10 t | both 0.5 | Good | >30 (Not sheared up to 30) | Defect ratio 0% |
| | 6 | Hot extrusion | 1150 | Outer diam.: 73.0 ϕ<br>Inner diam.: 62.7 ϕ | 0.35 | Good | >30 (Not sheared up to 30) | Defect ratio 0% |
| | 7 | Hot extrusion | 1120 | Outer diam.: 73.0 ϕ<br>Inner diam.: 62.7 ϕ | 0.35 | Good | >30 (Not sheared up to 30) | Defect ratio 0% |
| | 8 | Hot extrusion | 840 | Outer diam.: 73.0 ϕ<br>Inner diam.: 63.5 ϕ | 0.75 | Good | >30 (Not sheared up to 30) | Defect ratio 0% |
| | 9 | Hot extrusion | 1150 | Outer diam.: 73.0 ϕ<br>Inner diam.: 62.7 ϕ | 0.35 | Good | >30 (Not sheared up to 30) | Defect ratio 0% |
| | 10 | Hot extrusion | 1130 | Outer diam.: 73.0 ϕ<br>Inner diam.: 62.7 ϕ | 0.35 | Good | >30 (Not sheared up to 30) | Defect ratio 0% |
| | 11 | Hot extrusion | 1170 | Outer diam.: 73.0 ϕ<br>Inner diam.: 63.5 ϕ | 0.75 | Good | >30 (Not sheared up to 30) | Defect ratio 0% |
| | 12 | Hot extrusion | 1170 | Outer diam.: 73.0 ϕ<br>Inner diam.: 63.5 ϕ | 0.75 | Good | >30 (Not sheared up to 30) | Defect ratio 0% |
| | 13 | Hot extrusion | 1170 | Outer diam.: 71.6 ϕ<br>Inner diam.: 62.7 ϕ | Outer surface: 0.7<br>Inner surface: 0.35 | Good | >30 (Not sheared up to 30) | Defect ratio 0% |
| | 14 | Hot extrusion | 1100 | Outer diam.: 71.6 ϕ<br>Inner diam.: 62.7 ϕ | Outer surface: 0.7<br>Inner surface: 0.35 | Good | >30 (Not sheared up to 30) | Defect ratio 0% |
| | 15 | Hot extrusion | 1150 | Outer diam.: 71.6 ϕ<br>Inner diam.: 62.7 ϕ | Outer surface: 0.7<br>Inner surface: 0.35 | Good | >30 (Not sheared up to 30) | Defect ratio 0% |
| | 16 | Hot extrusion | 1100 | Outer diam.: 71.6 ϕ<br>Inner diam.: 62.7 ϕ | Outer surface: 0.7<br>Inner surface: 0.35 | Good | >30 (Not sheared up to 30) | Defect ratio 0% |
| Comparative example | 17 | Hot rolling | 1150 | Cracking of cladding during hot woking | | — | — | — |
| | 18 | Hot rolling | 1150 | Cracking of cladding during hot woking | | — | — | — |
| | 19 | Hot rolling | 1130 | Cracking of cladding during hot woking | | — | — | — |
| | 20 | Hot rolling | 1130 | Cracking of cladding during hot woking | | — | — | — |
| | 21 | Hot rolling | 850 | Cracking of cladding during hot woking | | — | — | — |
| | 22 | Hot rolling | 850 | Cracking of cladding during hot woking | | — | — | — |
| | 23 | Hot rolling | 1150 | Bonding failure and separation of metal substrate and cobalt alloy plate | | — | — | — |
| | 24 | Hot extrusion | 1150 | Bonding failure and separation of metal substrate and nickel alloy tube | | — | — | — |

TABLE 3

| | Test No. | Metal substrate: Material JIS No. | Metal substrate: Thickness or diameter (mm) | Cladding: Material | Cladding: Principal components (wt %) | Cladding: Thickness (mm) | Surface clad | HIP Conditions: Temp. (°C.) | HIP Conditions: Time (h) | HIP Conditions: Pressure (kgf/cm$^2$) | Soaking conditions: Temp (°C.) | Soaking conditions: Holding time (h) |
|---|---|---|---|---|---|---|---|---|---|---|---|---|
| Invention | 1 | SB 46 | 200 t | Nickel alloy | 16Cr—16Mo—5Fe—4W—2Co-balance Ni | 10 | Top surface | 1150 | 1 | 1900 | 1150 | 3 |
| | 2 | SUS 321 | 200 t | Cobalt alloy | 28Cr—6Mo—2.5Ni—0.25C-balance Co | 10 | of slab | 1170 | 3 | 1500 | 1130 | 2 |
| | 3 | SB 46 | 200 t | Nickel alloy | 50Cr-balance Ni | both 10 | Top & bottom surfaces of slab | 1080 | 7 | 1000 | 1100 | 5 |
| | 4 | SCM 430 | Outer diam.: 170 ϕ Inner diam.: 78 ϕ | Cobalt alloy | 35Ni—20Cr—10Mo-balance Co | 5 | Inner surface | 1180 | 3 | 1900 | 1150 | 1 |
| | 5 | SCM 430 | Outer diam.: 170 ϕ Inner diam.: 78 ϕ | Cobalt alloy | 28Cr—6Mo—2.5Ni—0.25C-balance Co | 5 | of hollow round billet | 1180 | 1 | 800 | 1150 | 1 |
| | 6 | SCM 430 | Outer diam.: 170 ϕ Inner diam.: 78 ϕ | Titanium alloy | 6Al—4V-balance Ti | 5 | | 830 | 3 | 1200 | 860 | 3 |
| | 7 | SNCM 420 | Outer diam.: 170 ϕ Inner diam.: 88 ϕ | JIS No. SUS 317L | 19Cr—13Ni—3.5Mo-balance Fe | 10 | | 1170 | 3 | 1800 | 1150 | 2 |
| | 8 | SNCM 420 | Outer diam.: 170 ϕ Inner diam.: 88 ϕ | Fe-base superalloy | 21Cr—35Ni—4Mo—2Cu-balance Fe | 10 | | 1150 | 4 | 1800 | 1130 | 2 |
| | 9 | SCM 430 | Outer diam.: 160 ϕ Inner diam.: 78 ϕ | Inner surface: Nickel alloy Outer surface: Cobalt alloy | Inner surface: 28Mo—5Fe—2Co-balance Ni Outer surface: 28Cr—6Mo—2.5Ni—0.25C-balance Co | Inner surface: 5 Outer surface: 5 | Inner and outer surfaces of hollow round billet | 1170 | 1 | 2000 | 1150 | 3 |
| | 10 | STBA 26 | Outer diam.: 160 ϕ Inner diam.: 78 ϕ | Inner surface: JIS No. SUS 347H Outer surface: Stainless steel | Inner surface: 18Cr—12Ni—0.7Nb-balance Fe Outer surface: 27Cr—26Ni-balance Fe | Inner surface: 5 Outer surface: 5 | | 1130 | 3 | 1800 | 1150 | 4 |
| | 11 | STBA 24 | Outer diam.: 160 ϕ Inner diam.: 78 ϕ | Inner surface: JIS No. SUS 347H Outer surface: Nickel alloy | Inner surface: 18Cr—12Ni—0.7Nb-balance Fe Outer surface: 50Cr-50Ni | Inner surface: 5 Outer surface: 5 | | 1130 | 5 | 1800 | 1100 | 7 |
| Comparative examples | 12 | SCM 430 | Outer diam.: 170 ϕ Inner diam.: 78 ϕ | Nickel alloy | 16Cr—16Mo—5Fe—4W—2Co-balance Ni | 5 | Inner surface | 1080 | 3 | 1600 | 980* | 2 |
| | 13 | SCM 430 | Outer diam.: 170 ϕ Inner diam.: 78 ϕ | Nickel alloy | 16Cr—16Mo—5Fe—4W—2Co-balance Ni | 5 | of hollow round billet | 1020* | 1 | 1200 | No soaking* | |
| | 14 | SB 46 | Outer diam.: 170 ϕ Inner diam.: 78 ϕ | Cobalt alloy | 29Cr—8W—2Ni—1.4C-balance Co | 5 | | 1150 | 2 | 1800 | 1000* | 3 |
| | 15 | SB 46 | Outer diam.: 170 ϕ Inner diam.: 78 ϕ | Cobalt alloy | 29Cr—8W—2Ni—1.4C-balance Co | 5 | | 1150 | 2 | 1800 | No soaking* | |
| | 16 | SCM 435 | Outer diam.: 170 ϕ Inner diam.: 78 ϕ | Titanium alloy | 6Al—4V-balance Ti | 5 | | 850 | 2 | 1500 | 420* | 1 |
| | 17 | SCM 435 | Outer diam.: 170 ϕ Inner diam.: 78 ϕ | Titanium alloy | 6Al—4V-balance Ti | 5 | | 870 | 2 | 1800 | No soaking* | |

TABLE 4

| | Test No. | Hot working method | Heating temp. # (°C.) | Product dimentions: Thickness or diameter of metal substrate (mm) | Product dimentions: Cladding thickness (mm) | Product test result: Bending Test | Product test result: Bonding strength (kg/mm$^2$) | Product test result: Bonding defect length ratio (%) |
|---|---|---|---|---|---|---|---|---|
| Invention | 1 | Hot rolling | 1150 | 10 t | 0.5 | Good | >6 (bonding agent severed at 6) | 0 |
| | 2 | Hot rolling | 1130 | 10 t | 0.5 | Good | >6 (bonding agent severed at 6) | 0 |
| | 3 | Hot rolling | 1100 | 10 t | both 0.5 | Good | >6 (bonding agent severed at 6) | 0 |
| | 4 | Hot extrusion | 1150 | Outer diam.: 60.4 ϕ<br>Inner diam.: 54.4 ϕ | 0.2 | Good | >6 (bonding agent severed at 6) | 0 |
| | 5 | Hot extrusion | 1150 | Outer diam.: 60.4 ϕ<br>Inner diam.: 54.4 ϕ | 0.2 | Good | >6 (bonding agent severed at 6) | 0 |
| | 6 | Hot extrusion | 860 | Outer diam.: 60.4 ϕ<br>Inner diam.: 54.4 ϕ | 0.2 | Good | >6 (bonding agent severed at 6) | 0 |
| | 7 | Hot extrusion | 1170 | Outer diam.: 73.0 ϕ<br>Inner diam.: 63.5 ϕ | 0.75 | Good | >6 (bonding agent severed at 6) | 0 |
| | 8 | Hot extrusion | 1170 | Outer diam.: 73.0 ϕ<br>Inner diam.: 63.5 ϕ | 0.75 | Good | >6 (bonding agent severed at 6) | 0 |
| | 9 | Hot extrusion | 1150 | Outer diam.: 60.0 ϕ<br>Inner diam.: 54.4 ϕ | Outer surface: 0.4<br>Inner surface: 0.2 | Good | >6 (bonding agent severed at 6) | 0 |
| | 10 | Hot extrusion | 1150 | Outer diam.: 71.6 ϕ<br>Inner diam.: 62.7 ϕ | Outer surface: 0.7<br>Inner surface: 0.35 | Good | >6 (bonding agent severed at 6) | 0 |
| | 11 | Hot extrusion | 1100 | Outer diam.: 71.6 ϕ<br>Inner diam.: 62.7 ϕ | Outer surface: 0.7<br>Inner surface: 0.35 | Good | >6 (bonding agent severed at 6) | 0 |
| Comparative example | 12 | Hot extrusion | 980 | Cracking of cladding during hot woking ## | | — | — | — |
| | 13 | Hot extrusion | 1150 | Cracking of cladding during hot woking ## | | — | — | — |
| | 14 | Hot extrusion | 1000 | Cracking of cladding during hot woking ## | | — | — | — |
| | 15 | Hot extrusion | 1130 | Cracking of cladding during hot woking ## | | — | — | — |
| | 16 | Hot extrusion | 420 | Cracking of cladding during hot woking ## | | — | — | — |
| | 17 | Hot extrusion | 820 | Cracking of cladding during hot woking ## | | — | — | — |

Same as soaking temp. since hot woking conducted immediately after soaking.
Target dimentions: Outer diam. of metal substrate, 60.4 mm, thickness of cladding, 0.2 mm.

TABLE 5

| | Test No. | Metal substrate: Material JIS No. | Metal substrate: Thickness or diameter (mm) | Cladding: Material | Cladding: Principal components (wt %) | Cladding: Thickness (mm) | Surface clad | HIP Conditions: Temp. (°C.) | HIP Conditions: Time (h) | HIP Conditions: Pressure (kgf/cm$^2$) | Solution treatment conditions: Temp. (°C.) | Solution treatment conditions: Holding time (h) | Solution treatment conditions: Cooling rate (deg/sec) |
|---|---|---|---|---|---|---|---|---|---|---|---|---|---|
| Invention | 1 | SPV 46 | 200 t | Nickel alloy | 28Mo—5Fe—2Co-balance Ni | 10 | Top surface | 1190 | 2 | 1200 | 1150 | 1 | 10 |
| | 2 | SUS 316 | 200 t | Nickel alloy | 16Cr—16Mo—5Fe—4W—2Co-balance Ni | 10 | of slab | 1210 | 1 | 700 | 1180 | 1 | 10 |
| | 3 | SPV 46 | 200 t | Cobalt alloy | 35Ni—20Cr—10Mo-balance Co | both 10 | Top & bottom surfaces of slab | 1070 | 7 | 3000 | 1140 | 1.5 | 10 |
| | 4 | SCM 435 | Outer diam.: 170 ϕ Inner diam.: 78 ϕ | Cobalt alloy | 28Cr—6Mo—2.5Ni—0.25-balance Co | 5 | Inner surface | 1150 | 1 | 2000 | 1150 | 2 | 20 |
| | 5 | SCM 435 | Outer diam.: 170 ϕ Inner diam.: 78 ϕ | Nickel alloy | 28Mo—5Fe—2Co-balance Ni | 5 | of hollow round billet | 1150 | 2 | 1800 | 1100 | 5 | 20 |
| | 6 | SCM 435 | Outer diam.: 170 ϕ Inner diam.: 78 ϕ | Titanium alloy | 6Al—4V-balance Ti | 5 | | 830 | 2 | 2000 | 860 | 3 | 20 |
| | 7 | SCM 421 | Outer diam.: 170 ϕ Inner diam.: 88 ϕ | JIS No. SUS 317J1 | 18Cr—16Ni—5Mo-balance Fe | 10 | | 1180 | 2 | 2000 | 1160 | 7 | 20 |
| | 8 | SCM 421 | Outer diam.: 170 ϕ Inner diam.: 88 ϕ | Fe-base superalloy | 21Cr—35Ni—5Mo-balance Fe | 10 | | 1180 | 2 | 2000 | 1160 | 8 | 20 |
| | 9 | SCM 421 | Outer diam.: 160 ϕ Inner diam.: 78 ϕ | Inner surface: Nickel alloy Outer surface: Cobalt alloy | Inner surface: 16Cr—16Mo—5Fe—4W—2Co-balance Ni Outer surface: 28Cr—6Mo—2.5Ni—0.25C-balance Co | Inner surface: 5 Outer surface: 5 | Inner and outer surfaces of hollow round billet | 1170 | 2 | 1400 | 1190 | 0.7 | 20 |
| | 10 | STBA 26 | Outer diam.: 160 ϕ Inner diam.: 78 ϕ | Inner surface: JIS No. SUS 347H Outer surface: Stainless steel | Inner surface: 18Cr—12Ni—0.7Nb-balance Fe Outer surface: 28Cr—30Ni-balance Fe | Inner surface: 5 Outer surface: 5 | | 1130 | 3 | 1000 | 1130 | 5 | 20 |
| | 11 | STBA 24 | Outer diam.: 160 ϕ Inner diam.: 78 ϕ | Inner surface: JIS No. SUS 347H Outer surface: Nickel alloy | Inner surface: 18Cr—12Ni—0.7Nb-balance Fe Outer surface: 30Cr-balance Ni | Inner surface: 5 Outer surface: 5 | | 1130 | 5 | 1000 | 1130 | 5 | 20 |
| Comparative examples | 12 | SCM 430 | Outer diam.: 170 ϕ Inner diam.: 78 ϕ | Nickel alloy | 28Mo—5Fe—2Co-balance Ni | 5 | Inner surface of hollow round billet | 1000* | 3 | 1500 | 1000* | 1 | 20 |
| | 13 | SCM 430 | | Nickel alloy | 28Mo—5Fe—2Co-balance Ni | 5 | | 1100 | 1 | 1700 | 1100 | 1.5 | 0.05* |
| | 14 | SCM 430 | | Nickel alloy | 28Mo—5Fe—2Co-balance Ni | 5 | | 1130 | 1 | 2000 | No solution treatment* | | |
| | 15 | SPV 46 | | Cobalt alloy | 29Cr—8W—2Ni—1,4C-balance Co | 5 | | 1150 | 2 | 1800 | 990* | 2 | 10 |
| | 16 | SPV 46 | | Cobalt alloy | 29Cr—8W—2Ni—1,4C-balance Co | 5 | | 1150 | 2 | 1800 | 1100 | 2 | 0.1* |
| | 17 | SPV 46 | | Cobalt alloy | 29Cr—8W—2Ni—1,4C-balance Co | 5 | | 1130 | 0.2* | 1800 | No solution treatment* | | |
| | 18 | SCM 435 | | Titanium alloy | 6Al—4V-balance Ti | 5 | | 870 | 2 | 1800 | 360* | 5 | 20 |
| | 19 | SCM 435 | | Titanium alloy | 6Al—4V-balance Ti | 5 | | 870 | 2 | 1800 | 850 | 1 | 0.1* |
| | 20 | SCM 435 | | Titanium alloy | 6Al—4V-balance Ti | 5 | | 850 | 2 | 1500 | No solution treatment* | | |

TABLE 6

| | Test No. | Hot working method | Heating temp. (°C.) | Product dimentions: Thickness or diameter of metal substrate (mm) | Product dimentions: Cladding thickness (mm) | Product test result: Bending Test | Product test result: Bonding strength (kg/mm$^2$) | Product test result: Bonding defect length ratio (%) |
|---|---|---|---|---|---|---|---|---|
| Invention | 1 | Hot rolling | 1150 | 10 t | 0.5 | Good | >6 (bonding agent severed at 6) | 0 |
| | 2 | Hot rolling | 1100 | 10 t | 0.5 | Good | >6 (bonding agent severed at 6) | 0 |
| | 3 | Hot rolling | 1160 | 10 t | both 0.5 | Good | >6 (bonding agent severed at 6) | 0 |
| | 4 | Hot extrusion | 1130 | Outer diam.: 60.4 ϕ<br>Inner diam.: 54.4 ϕ | 0.2 | Good | >6 (bonding agent severed at 6) | 0 |
| | 5 | Hot extrusion | 1130 | Outer diam.: 60.4 ϕ<br>Inner diam.: 54.4 ϕ | 0.2 | Good | >6 (bonding agent severed at 6) | 0 |
| | 6 | Hot extrusion | 850 | Outer diam.: 60.4 ϕ<br>Inner diam.: 54.4 ϕ | 0.2 | Good | >6 (bonding agent severed at 6) | 0 |
| | 7 | Hot extrusion | 1170 | Outer diam.: 73.0 ϕ<br>Inner diam.: 63.5 ϕ | 0.75 | Good | >6 (bonding agent severed at 6) | 0 |
| | 8 | Hot extrusion | 1170 | Outer diam.: 73.0 ϕ<br>Inner diam.: 63.5 ϕ | 0.75 | Good | >6 (bonding agent severed at 6) | 0 |
| | 9 | Hot extrusion | 1150 | Outer diam.: 60.0 ϕ<br>Inner diam.: 54.4 ϕ | Outer surface: 0.4<br>Inner surface: 0.2 | Good | >6 (bonding agent severed at 6) | 0 |
| | 10 | Hot extrusion | 1150 | Outer diam.: 71.6 ϕ<br>Inner diam.: 62.7 ϕ | Outer surface: 0.7<br>Inner surface: 0.35 | Good | >6 (bonding agent severed at 6) | 0 |
| | 11 | Hot extrusion | 1100 | Outer diam.: 71.6 ϕ<br>Inner diam.: 62.7 ϕ | Outer surface: 0.7<br>Inner surface: 0.35 | Good | >6 (bonding agent severed at 6) | 0 |
| Comparative example | 12 | Hot extrusion | 1130 | Cracking of cladding during hot woking # | | — | — | — |
| | 13 | Hot extrusion | 1130 | Cracking of cladding during hot woking # | | — | — | — |
| | 14 | Hot extrusion | 1130 | Cracking of cladding during hot woking # | | — | — | — |
| | 15 | Hot extrusion | 1160 | Cracking of cladding during hot woking # | | — | — | — |
| | 16 | Hot extrusion | 1160 | Cracking of cladding during hot woking # | | — | — | — |
| | 17 | Hot extrusion | 1160 | Cracking of cladding during hot woking # | | — | — | — |
| | 18 | Hot extrusion | 830 | Cracking of cladding during hot woking # | | — | — | — |
| | 19 | Hot extrusion | 830 | Cracking of cladding during hot woking # | | — | — | — |
| | 20 | Hot extrusion | 830 | Cracking of cladding during hot woking # | | — | — | — |

#Target dimentions: Outer diam. of metal substrate, 60.4 mm, thickness of cladding, 0.2 mm.

What is claimed is:

1. A method of producing clad metal comprising the steps of forming a cladding on the surface of a metal substrate by subjecting powder of a metal which is of a different type from that of the metal substrate and is selected from among Ni-base alloys, Co-base alloys, Ti-base alloys, Fe-base superalloys and stainless steels to hot isostatic pressing under a gas pressure load of not less than 300 $Kg/cm^2$ at a temperature not higher than the solidus thereof, thereby to obtain a composite material, and elongating the composite material by hot working.

2. A method as defined in claim 1 wherein both surfaces of the metal substrate are provided with claddings of metals of the same or different types.

3. A method as defined in claim 1 or 2 wherein the powder consists of Ni-base alloy or Co-base alloy and the hot isostatic pressing is carried out at a temperature of 1050°-1240° C. for 0.5-10 h.

4. A method as defind in claim 1 or 2 wherein the metal substrate consists of Fe-base alloy, the powder consists of Ti-base alloy and the hot isostatic pressing is carried out at a temperature of 600°-900° C. for 0.5-10 h.

5. A method of producing clad metal comprising the steps of forming a cladding on the surface of a metal substrate by subjecting powder of a metal which is of a different type from that of the metal substrate and is selected from among Ni-base alloys, Co-base alloys, Ti-base alloys, Fe-base superalloys and stainless steel to hot isostatic pressing under a gas pressure load of not less than 300 $Kg/cm^2$ at a temperature not higher than the solidus thereof, thereby to obtain a composite material, subjecting the composite material to soaking, and immediately thereafter elongating the composite material by hot working.

6. A method as defined in claim 5 wherein both surfaces of the metal substrate are provided with claddings of metals of the same or different types.

7. A method as defined in claim 5 or 6 wherein the powder consists of Ni-base alloy or Co-base alloy, the hot isostatic pressing is carried out at a temperature of 1050°-1240° C. for 0.5-10 h, and the soaking is carried out at a temperature of 1050°-1240° C. for 0.5-10 h.

8. A method as defined in claim 5 or 6 wherein the metal substrate consists of Fe-base alloy, the powder consists of Ti-base alloy, the hot isostatic pressing is carried out at a temperature of 600°-900° C. for 0.5-10 h, and the soaking is carried out at a temperature of 550°-900° C. for 0.5-10 h.

9. A method of producing clad metal comprising the steps of forming a cladding on the surface of a metal substrate by subjecting powder of a metal which is of a different type from that of the metal substrate and is selected from among Ni-base alloys, Co-base alloys, Ti-base alloys, Fe-base superalloys and stainless steel to hot isostatic pressing under a gas pressure load of not less than 300 $Kg/cm^2$ at a temperature not higher than the solidus thereof, thereby to obtain a composite material, subjecting the composite material to solution treatment, and elongating the composite material by hot working.

10. A method as defined in claim 9 wherein both surfaces of the metal substrate are provided with claddings of metals of the same or different types.

11. A method as defined in claim 9 or 10 wherein the powder consists of Ni-base alloy or Co-base alloy, the hot isostatic pressing is carried out at a temperature of 1050°-1240° C. for 0.5-10 h, and the solution treatment is carried out by holding at a temperature of 1050°-1240° C. for 0.5-10 h and by rapid cooling at a rate of not less than 5 deg/sec.

12. A method as defined in claim 9 or 10 wherein the metal substrate consists of Fe-base alloy, the powder consists of Ti-base alloy, the hot isostatic pressing is carried out at a temperature of 600°-900° C. for 0.5-10 h, and the solution treatment is carried out by holding at a temperature of 550°-900° C. for 0.5-10 h and by rapid cooling at a rate of not less than 5 deg/sec.

* * * * *